United States Patent [19]

Briner et al.

[11] 4,375,744

[45] Mar. 8, 1983

[54] APPARATUS FOR CONTROLLING THE ROTATIONAL SPEED OF THE SPINDLES OF A SPINNING PREPARATORY MACHINE

[75] Inventors: Emil Briner; Peter Novak, both of Winterthur; Hermann Gasser, Frauenfeld, all of Switzerland

[73] Assignee: Rieter Machine Works Ltd., Winterthur, Switzerland

[21] Appl. No.: 261,153

[22] PCT Filed: Sep. 3, 1980

[86] PCT No.: PCT/EP80/00091

§ 371 Date: May 28, 1981

§ 102(e) Date: Apr. 20, 1981

[87] PCT Pub. No.: WO81/00866

PCT Pub. Date: Apr. 2, 1981

[30] Foreign Application Priority Data

Sep. 28, 1979 [CH] Switzerland ..... 8768/79

[51] Int. Cl.[3] ..... D01H 1/26; D01H 1/04

[52] U.S. Cl. ..... 57/96; 57/264

[58] Field of Search ..... 57/95–99, 57/94, 264, 265

[56] References Cited

U.S. PATENT DOCUMENTS

| | | | |
|---|---|---|---|
| 3,572,026 | 3/1971 | Herubel | 57/96 |
| 3,892,064 | 7/1975 | Araki et al. | 57/96 |
| 4,134,253 | 1/1979 | Handa et al. | 57/264 X |
| 4,254,615 | 3/1981 | Adolf et al. | 57/96 |

FOREIGN PATENT DOCUMENTS

| | | |
|---|---|---|
| 1204982 | 11/1965 | Fed. Rep. of Germany . |
| 1291664 | 3/1969 | Fed. Rep. of Germany . |
| 815560 | 4/1937 | France . |
| 1401075 | 4/1965 | France . |

*Primary Examiner*—John Petrakes

*Attorney, Agent, or Firm*—Werner W. Kleeman

[57] ABSTRACT

The invention concerns an apparatus for controlling the rotational speed of the spindles of a spinning preparatory machine equipped with spindles and flyers.

The proposed control arrangement comprises an infinitely variable variator, which is adapted or adjusted by using a control shaft which is rotatably indexed or stepped. The control or adjustment shaft is moved by a control motor which received its control or switching impulses from a motor control device comprising a programmable indicator or set value transmitter for the desired or set value and a correction element.

According to a particularly advantageous design the correction element is of the form of a crossbar distributor arrangement.

The apparatus is comfortable and easy to use by the operating personnel and permits, among other advantages, extremely accurate adaptation or adjustment of the spindle rotational speed. The adaption operations can be effected while the machine is running.

6 Claims, 3 Drawing Figures

APPARATUS FOR CONTROLLING THE ROTATIONAL SPEED OF THE SPINDLES OF A SPINNING PREPARATORY MACHINE

BACKGROUND OF THE INVENTION

The present invention concerns an apparatus for controlling the rotational speed of the spindles of a spinning preparatory machine equipped with spindles and with flyers operatively coordinated thereto, as a function of the increasing bobbin diameter. The control apparatus contains a variator for driving the spindles, and such variator can be infinitely varied by using a control shaft which is stepwise rotated.

In a spinning preparatory machine of this type, also called roving frame or fly frame, a fibre roving is produced and is wound in parallel windings onto the bobbin of each spinning position, using a flyer. As the fibre roving is to be draftable as input material to be fed to the next processing step, a very low twist is imparted to it, barely sufficient for tensionless transfer of the fibre roving to a drafting arrangement of the subsequent processing step, but resulting in an undesirable faulty draft in the roving under the smallest tensile stress.

With such spinning preparatory machines it is necessary to drive both the spindle, and the flyer, which distributes the fibre roving over the bobbin surface and which flyer rotates coaxially with the spindle, and furthermore to precisely adjust the mutual rotational speeds.

In this arrangement the flyer, as a rule, rotates at a constant rotational speed, while the rotational speed of the spindle is adapted according to the increasing bobbin diameter: the spindle, in this arrangement, performs the reciprocating spindle rail stroke between two reversal points moving with respect to space as a function of the bobbin diameter, this traversing stroke ensuring for both the winding of the fibre roving in parallel windings onto the bobbin surface and the conical built or formed shape of the bobbin extremities.

The present invention deals with the problem of adapting the rotational speed of the spindle to the increasing bobbin diameter, and there is not specifically involved the reduction of the spindle rail traverse stroke as a function of the bobbin diameter.

The increase of the bobbin diameter, however, decisively depends on the technological properties of the roving produced, such as e.g. fibre type and quality, count (or linear density), twist, volume, etc. Experience has shown, that e.g. the volume of a roving of this type, or its cross-section respectively, depends on the air or climatic conditions, i.e. it can vary over time, and that also such minute variations already constitute a disturbing factor in the winding process, which is to be corrected using suitable means.

In the state of the art, countless propositions for controlling the rotational speed of a spinning preparatory machine of this type are known, in which machine, for obtaining the precision control which is required, usually a coarse control device and a fine control device are applied working in combination. Using the coarse control device, the best known form of which and that which is most universally utilized is a double-cone belt drive arrangement, the rotational speed of the spindle is roughly adapted to the geometric dimensions of the bobbin and in particular to its diameter. Using the fine control device, which frequently is in the form of a multi-member compensating rail, the speed ratio of the cone belt drive is influenced and a fine correction of the roving tension at different diameters of the bobbin is effected.

A solution of this type is shown, e.g. in Swiss Pat. No. 569,806. As a correcting rail here a control surface is used, which over the whole zone of the belt shifting of the cone belt drive exerts a correcting influence thereon. In a solution of this type with a double cone belt drive arrangement, of course, also adaption of the average speed of the belt shifting movement to the roving volume is required, which as a rule is effected by insertion of a gear train with exchangeable gears. Typical for this solution is the application of an infinitely variable variator, which is adjusted by a control shaft, which is rotated stepwise. The disadvantages of this known solution reside in its poor operatability and in its complicated design. Setting the elements for the rough control (e.g. the change gear for shifting the double cone belt) as well as for the fine control is to be effected while the machine is at a standstill, as manipulations are performed at the gear train. The whole operation of adjusting the settings of the control elements, which is to be extended over several complete doff cycles, if the success of the adjustments effected is to be judged, is very time-consuming and complicated, and thus the spinning preparatory machine in many cases is not set optimally but to approximate accuracy only. The resulting faulty drafts in the roving and an increased number of roving breakages result in corresponding stoppages, causing downtime and deterioration in machine efficiency.

Also the adaption to the variable air conditions in the spinning room proves very problematic in view of the above mentioned operational disadvantages of the known devices.

A further disadvantage of the known device is seen in that it requires a great deal of maintenance, particularly cleaning and lubrication operations. Furthermore, in a device of such type the disadvantage is to be mentioned that the control elements are to be equipped with particular resetting elements, using e.g. the belt of the double cone belt drive which is to be brought back into its starting position after the belt has been released while the machine is at a standstill. For this purpose, e.g. a releasing device for the cones and a separate resetting motor, which are active merely during the very short time period of the resetting operation, are required, the device thus becoming still more complicated and expensive.

Solutions similar to the one described here are described e.g. in French Pat. No. 15 66 512 and in German Patent Application No. 12 91 664. For these the disadvantages cited in connection with the above mentioned state of the art also apply.

In other known devices for a spinning preparatory machine, control of the rotational speed of the spindle is effected in that the roving tension is maintained constant, which implies that the roving tension is measured.

This control technique, based only on the winding conditions at individual spinning positions, requires a relatively complex installation of measuring instruments, but does not ensure that the roving tension is correct at the other spinning positions. If, unfortunately, just the one spinning position at which the roving tension is measured, runs extremely tight or extremely slack, all other spinning positions which might run correctly are corrected correspondingly in such a manner that, at these spinning positions, the complexity of the arrangement notwithstanding, optimum spinning conditions are not obtained.

SUMMARY OF THE INVENTION

It thus is an object of the present invention to eliminate the disadvantages heretofore mentioned of the known devices and to propose an apparatus of the above mentioned type, in which in particular:

(a) Setting of the rotational speed of the spindles, or the control of the roving tension, respectively, is extremely accurate and simple over the whole bobbin build or formation;

(b) Setting of the rotational speed of the spindles is possible while the machine is running;

(c) Operation of the apparatus is simple, maintenance work required is reduced, and no separate resetting elements are required.

These and other advantages can be achieved by an apparatus for controlling the rotational speed of the spindles in a spinning preparatory machine, equipped with spindles and with flyers coordinated thereto, as a function of the increasing bobbin diameter, using an infinitely variable variator adjusted by a control shaft rotated stepwise, for the drive of the spindles, in that the control shaft is driven by an electrical setting motor, which receives control impulses from a motor control device, the motor control device comprising a programmable indicator of the desired value, and an adjustable correction element, using the impulse member set on the desired value indicator which can be corrected in each control step by adding or by subtracting correction impulses, and in that the command for generation of control impulses for the motor control is activated by a device scanning the reversal points of the spindle rail traversing movement and/or that the correcting element is connected with a device scanning the increasing bobbin diameter. The drive arrangement for the control shaft for adjusting the variator using a setting motor creates the prerequisite conditions for achieving the above mentioned advantages, as described in more detail in the following with reference to illustrated design examples.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
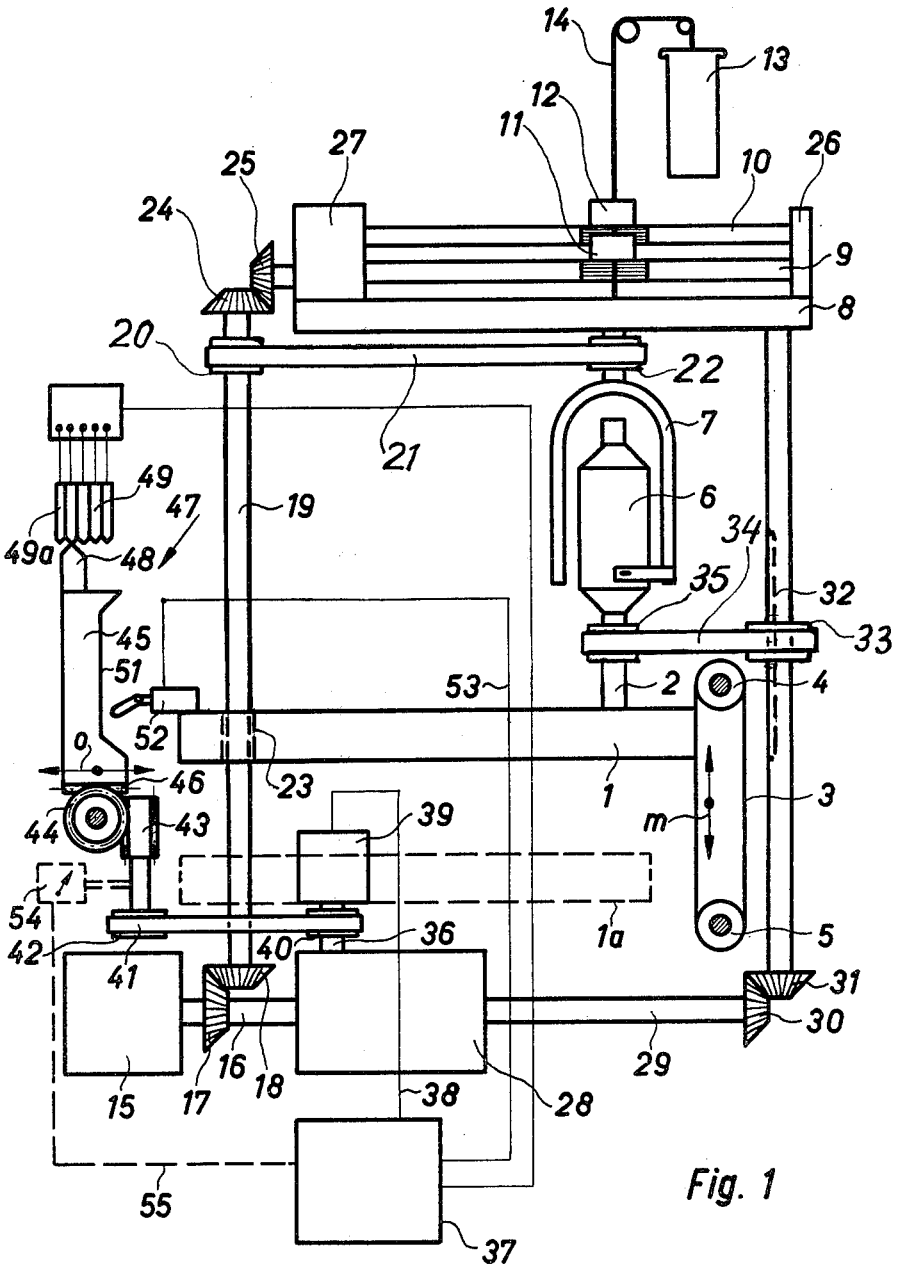
FIG. 1 is an overall view of a spinning preparatory machine equipped with the inventive control apparatus.

In FIG. 1 a spinning preparatory machine is shown, equipped with spindles and with flyers coordinated thereto, in a schematic and simplified view, showing the working elements as far as required for understanding the invention.

A spinning preparatory machine of such type comprises spindles 2 rotatably supported in one row or in a plurality of rows on a spindle rail 1, one spindle 2 only being shown to simplify the illustration. The spindle rail 1 is traversed up and down vertically, and for this purpose is guided in vertical guides not shown, and is coupled with a traversing mechanism here only indicated schematically. According to the exemplary arrangement of traversing mechanism as shown, which represents just one of a large number of possible solutions within the scope of the invention, the spindle rail 1 is connected at least at two points (one only being shown) to one of the vertical runs or legs of a chain 3 revolving between an upper deflecting roll 4 and a lower deflecting roll 5. One of the rolls 4 or 5 respectively, is driven alternatingly in both directions by a system known as such and not here described in greater detail, in such manner that the spindle rail 1 performs an alternating up and down traversing movement as indicated by the double-headed arrow m.

The type of traversing mechanism chosen for effecting the vertical movement of the spindle rail 1, required for distributing the roving over the bobbin surface to form a package, is of no consequence as concerns the specific teachings of the present invention, it is merely of importance that the reversal of the vertical movement is effected by a device or means for scanning the spindle rail traverse stroke, as will be explained later on in greater detail. Furthermore, the machine can be equipped with a traversing mechanism performing a constant stroke, so that there are formed bobbin packages having cylindrical ends, or else the traversing mechanism can perform a stroke diminishing as a function of the bobbin diameter, stroke diminishing as a function of the bobbin diameter, in order to produce bobbin packages having conical ends.

The solution for performing a diminishing traverse stroke here has been chosen merely as an example, this solution corresponding to the usual arrangement in practical mill use. The solution described here, however, as will be explained clearly in the course of the description later on, advantageously also can be applied in a spinning preparatory machine performing a constant traverse stroke.

On the spindle 2 a bobbin 6 is placed, onto which the fibre roving is wound to form a bobbin package. A flyer 7 is rotatably supported coaxial with each spindle 2 in a flyer rail 8 arranged fixedly with respect to the room. The spinning preparatory machine shown here thus is of the suspended flyer type; this machine type, however, is exemplary and does not represent a condition absolutely required within the context of the present invention. The present invention also is applicable without difficulties on any other known type of spinning preparatory machine (e.g. with "standing" flyer, with so-called "closed" flyers, i.e. flyers of the type guided only at their upper end, but not driven).

Above the flyers 7, which are arranged in correspondence to the spindles 2 in one row or in a plurality of rows, there is furthermore provided a drafting arrangement consisting of cylinders 9 and 10 extending through the machine and coresponding pressure rolls 11 and 12. The fibre sliver 14 coming from a can 13 is drafted in the drafting arrangement 9 through 12 to a fineness desired and subsequently, while imparting twist, in known manner, is transferred to the flyer 7 and finally to the bobbin 6 of the spindle 2. In an arrangement of this type, control of the winding conditions on the bobbin 6, i.e. accurate control of the rotational speeds of the working elements, is of exceptional importance, as the winding of the fibre roving 14 emerging from between the cylinders 9 and 11 and not able to withstand any tensile tension, is to be effected free of tension, or at a very low, controlled tension, respectively, throughout the whole bobbin package formation or build.

The present invention concerns an apparatus for controlling these winding conditions.

In the design example shown in FIG. 1 the drive of the working elements is effected as follows:

An electrical motor 15 drives a main shaft 16 at constant speed. On this main shaft 16 there is seated a bevel or conical gear 17, which meshes with a bevel or conical gear 18 of a vertical shaft 19. On shaft 19 there is rigidly mounted for rotation a belt pulley 20, for a belt 21 cooperating with a belt pulley 22 provided on the flyer 7 in order to rotate this flyer 7. The shaft 19 rotates with its axis being fixed in space whereas the spindle rail 1 performs the up and down traversing movement described above (according to the double-headed arrow m); for this purpose the spindle rail 1 is provided with a large bore 23 for piercingly receiving the shaft 19. In FIG. 1 the lowest position 1*a* of the spindle rail 1 has been indicated with broken or phantom lines. The shaft 19 is provided at is upper end with a bevel gear 24 meshing with a bevel gear 25 for driving the drafting arrangement 9 through 12 of the spinning preparatory machine. The cylinders or rolls 9 and 10 of the drafting arrangement, extending throughout the machine, are supported in the supports 26 and 27 which are rigidly connected with the flyer rail 8; the support 27 furthermore is designed as a gear arrangement, i.e. also contains the gears (not shown) for transmitting the rotational movement of the gear 25 to both, or all, cylinders 9 and 10 of the drafting arrangement, while taking into account the speed difference between the cylinders 9 and 10 required according to the draft (desired). The flyer 7 and the drafting arrangement times are thus driven to be mutually synchronous at all times, since they are kinematically rigidly interconnected.

The rotational speed of the spindle 2 must be adapted according to the increasing diameter of the bobbin 6, and this adaption must be effected so accurately that the roving tension between the delivery cylinders or rolls 9, 11 and the flyer 7 is maintained as constant as possible. Experience has shown that this task cannot be merely achieved by using a variator controlled according to the known mathematical formula for the increase in diameter. The external influence acting upon the fibre roving 14 during the winding operation (such as e.g. the air or climatic conditions) and the variations of the winding conditions already influence the roving volume and the bobbin density in such a manner that a possibility of adaption, in the sense of a fine control active over the whole bobbin build in addition to the variator mentioned, (even if the latter is working "theoretically correctly") is indispensable. Only if the roving tension, as mentioned above, is used directly as a control value, a variator alone can fulfil the control function in principle, but this method shows the disadvantages cited initially and thus is unsatisfactory.

The present invention is based on the above mentioned findings, that (without direct measurement of the roving tension) a correct control of the rotational speed of the spindle only can be achieved by a combination of a basic control, which takes care of the average values of the technological characteristics (roving count, fibre characteristics, i.e. fineness, maturity, crimp, etc.) and a correcting control which can be finely adapted or adjusted over the whole bobbin build or package formation.

This is achieved by using an apparatus according to FIG. 1 in such a manner that the main shaft 16 is used as input shaft of an infinitely adjustable variator 28. The output shaft 29 of the variator 28 rotates at a controlled rotational speed and drives, via the bevel gears 30/31, the vertical shaft 32, the belt pulley 33, the belt 34, the whorl 35, and thus the spindle 2.

The belt 21 as well as the belt 34 are preferably slippage-free toothed belts, and in this case the pulleys 20, 22 and 33 as well as the whorl 35 are provided with a suitable arrangement of teeth.

The rotational speed of the spindle 2 at each moment is adapted to the prevailing winding conditions by correspondingly adapting the infinitely variable variator 28, the variator 28 being adjusted or adapted by a control shaft 36 which is rotated stepwise, the control of which rotatably indexible shaft concerns the actual subject matter of the invention.

According to the invention the control shaft 36, which is rotated stepwise, is driven by a setting or adjustment motor 39 which receives control or switching impulses from a motor control device 37 via an electric circuit or line 38. The stepwise rotation of the control shaft 36 is activated by the deposition of the roving windings in layers on the bobbin surface, which requires a stepwise adaptation of the rotational speed of the spindle, according to the stepwise increase in bobbin diameter.

In FIG. 1 it will be seen that the control shaft 36 is provided with a belt pulley 40 for a toothed belt 41, by means of which there is driven the belt pulley 42 of a device 47, comprising a worm gear 43, a gear 44 and a cam or curve 45 provided with a gear rack 46 for determining the bobbin diameter.

The bobbin diameter-sensing or determining device 47 furthermore comprises a contactor 48, which successively is brought into contact with a plurality of contact transmitters 49 arranged along the path of movement of the contactor 48. Via the circuit or line 50 the contact transmitters 49 are connected with the motor control 37, in such manner that the position of the contactor 48 relative to the plurality of contact transmitters 49 can be transmitted to the motor control device 37.

The device 47, described here as an example, now functions as follows: If the bobbin 6 is empty, i.e. if an empty bobbin tube (not shown) is placed onto the spindle 2, the variator 28 is set to its starting position, as in this situation the spindle 2 is required to rotate at one of its extreme rotational speeds. In this starting position the cam or curve 45, which kinematically is connected rigidly with the control shaft 36 of the variator 28, also is arranged at its extreme right-hand side position, in such manner that the contactor 48 is in contact with the right-hand side contact transmitter 49; via the circuit or line 50 a signal is delivered to the motor control device 37, which signal corresponds to this starting position, or to the smallest bobbin diameter, respectively.

As the diameter of the bobbin or bobbin package 6 increases, the variator 28 must be adjusted correspondingly, which is effected by stepwise rotation or indexing of the control shaft 36: owing to the rigid coupling between the control shaft 36 and the cam or curve 45, and the contactor 48 respectively, each position of the control shaft 36, and of the variator 28 respectively, corresponds to a determined position of the cam or curve 45, since each position of the variator 28 corresponds to a determined bobbin diameter. As a result, also each position of the cam or curve 45 thus corresponds to a determined bobbin diameter. The device 47 thus is able to deliver a signal via circuit 50 to the motor control device 37, which corresponds to the momentary bobbin diameter, or to the momentary zone of the bobbin diameter corresponding to the spacing of the contact transmitters 49 along the path of the contactor 48.

It is to be mentioned here already, that the device 47, described here, for controlling the bobbin diameter is not the only one which can be considered within the scope of the invention. In principle, any device which can determine the diameter, or zones of diameters respectively, is applicable within the scope of the invention. Thus, e.g. also direct scanning of the bobbins, e.g. mechanically with direct contact of the bobbins, or e.g. contact-free optically, is applicable without difficulties, as the only condition required consists in that a signal is to be given off via the electric circuit or line 50 to the motor control device 37, which signal contains the information about the momentary diameter of the bobbin 6, subdivided, if required, into a determined number of layers.

The depicted solution of the device 47 however, possesses as a particular advantage, that it can achieve, in addition to the determination of the momentary bobbin diameter, also the control of the spindle rail traverse stroke during the bobbin formation or build, for achieving the desired contour or outline of the bobbin 6, in a manner to be described hereinafter. For this purpose the cam or curve plate 45 is used, the curve edge or cam surface 51 of which corresponds to the desired outline profile of the bobbin 6 in its cross-section (e.g. with two conical end portions). On the spindle rail 1 a limit switch 52 is mounted, which during the traversing movement of the spindle rail 1 is reversed at the upper and at the lower part of the curve or cam surface 51. The reversing limit switch 52 thus transmits via the electric circuit or line 53, at each reversal point of the spindle rail traverse stroke, a signal to the motor control device 37, which signal is required for the inventive control to be described in detail hereinafter. At the same time, reversal of the switch 52 can effect, via transmitting elements not shown, the reversal of the traversing movement, i.e. reversal of the direction of movement of the chain 3, this, however, not being a condition required within the scope of the invention.

Another design example of a device also suitable for determining the bobbin diameter is indicated in FIG. 1 with broken lines, which device, however, no longer is connected with the device for detecting the reversal points. There is shown schematically the manner in which the shaft of the pulley 42 (or the control shaft 36 directly, respectively) is coupled with a potentiometer 54; as the control shaft 36 rotates, the potentiometer 54 also is rotated further, each of its positions corresponding to a determined bobbin diameter. Via an electric circuit or line 55 the potentiometer 54, also in this arrangement, is connected with the motor control device 37 and transmits a signal to it, which corresponds to the momentary bobbin diameter.

Figure 2:
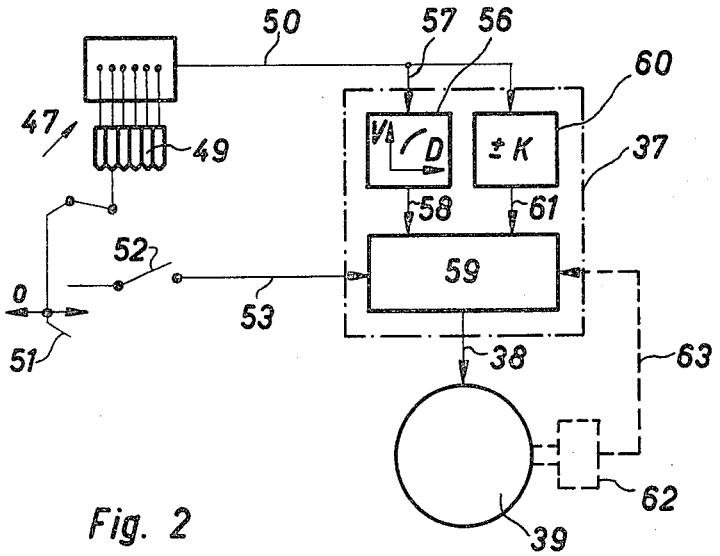
FIG. 2 is a block diagram of an inventive control apparatus for controlling a spinning preparatory machine as shown in FIG. 1.

The inventive layout of the motor control device 37 is shown in the block diagram in FIG. 2, elements identical with the ones shown in FIG. 1 being designated with the same reference numerals.

The motor control device 37 according to the invention comprises a programmable indicator or set value transmitter 56 for the desired value, which from the outside can be set for a determined number of switching or indexing impulses per switching or indexing step. In its broadest layout according to FIG. 2, the indicator or set value transmitter 56 for the desired value is programmable according to a determined relation between the spindle rotational speed V and the bobbin diameter D ($V=f(D)$) for the whole bobbin build or bobbin diameter range. This relation, which e.g. can be the known mathematical relation given by the geometrical dimensions of the bobbin, is to be considered as a first approximation of the control function, to which a correction, varying over the bobbin build as a function of the bobbin build or diameter, is to be superimposed. This correction takes care of the outer influences mentioned initially, acting upon the bobbin build.

According to the invention it is of importance merely, that the indicator or set value transmitter 56 for the desired value can be set by the operating personnel from the outside. Setting can consist, e.g. in inputting to the indicator 56 for the desired value a determined function $V=F(D)$, which today can be achieved by various means (e.g. via a programmable computer, or by scanning a control cam or curve, e.g. mechanically or optically, etc.).

If the indicator or set value transmitter 56 for the desired or set value functions by scanning a control cam or curve, the indicator 56 for the desired value is to be arranged in such a manner that exchange of the control cam or curve or its adaption can be effected by the operating personnel without tools, and without bringing the spinning preparatory machine to a standstill. The indicator or set value transmitter 56 for the desired or set value is connected with the circuit or line 50 via a branch circuit or line 57: via this circuit 57 it receives signals from the device 47 for determining the bobbin diameter, which signals correspond to the bobbin diameter. The indicator 56 for the desired or set value transmits via the electric circuit or line 50 a determined number of switching impulses to a logic device 59 arranged subsequently. Furthermore, the motor control device 37 according to the invention comprises a settable or adjustable correction element 60, by means of which the number of impulses determined by the indicator 56 of the desired value and corresponding to the relation $V=f(D)$ is corrected by adding or subtracting correction impulses or pulses during each switching or indexing step. The correction element 60 also is connected with the electric circuit or line 50 and is supplied therefrom with a signal corresponding to the bobbin diameter. It transmits its correction pulses or impulses to the logic device 59 via an electric circuit or line 61. The control device according to FIG. 1 now functions as follows:

Each time an adaption of the rotational speed of the spindles is to be effected, since a new layer of roving is wound onto the bobbin 6 in such a manner that the winding diameter of the bobbin 6 changes, the spindle rail 1 has reached one of the reversal points and thus activates the reversing switch 52. This switch in turn transmits (aside from the signal for reversal of the traversing direction of the traversing mechanism, which is of no consequence in this context) a signal via the circuit or line 53 to the motor control device 37, and to its logic device or element respectively. The logic device 59 obtains from the set value transmitter or indicator 56 for the desired or set value the number of control impulses corresponding to the bobbin diameter and adapted thereto, which indicate the approximating relation V=f (D). From the correction element 60 the logic device 59 simultaneously obtains the correction corresponding to, and adapted to, the bobbin diameter, which correction consists in a determined number of negative or positive pulses. The logic device 59 sums up the pulses from the indicator 56 for the desired or set value and from the correction element 60, and transmits via the circuit or line 38 a control or adjustment signal corresponding to the momentary winding conditions to the control or adjustment motor 39. The adjustment of the control or adjustment motor 39 is checked by using a feedback arrangement (comprising a signal transmitter 62 and an electrical circuit 63, both indicated with broken lines), which establishes the connection between the control motor 39 and the control device 37.

The control arrangement, described here, for a spinning preparatory machine presents the great advantage that, owing to the separate rough control using the set value transmitter or indicator 56 for the desired value, and the separate time control using the correction element 60 a comfortable and extremely accurate control of the spindle speed over the whole bobbin build or package formation can be effected. Furthermore, it permits the application of any type of variator 28, since it does not require a given transmission ratio characteristic for the variator 28. This results from the programmability of the indicator 56 for the desired or set value, which without difficulties can be chosen such that it can take care of any desired transmission ratio characteristic of the variator 28.

Further advantages are presented by a preferred embodiment of the invention if the indicator or set value transmitter 56 for the desired value as well as the correction element 60 are freely accessible to the operating personnel, i.e. without opening of housing covers, e.g. at the drive head stock of the machine, and can be set or adapted while the machine is running. Thus, the operating personnel can effect the adaption of the spindle rotational speed as required, without disturbing the tension conditions prevailing in the roving 14, which are to be corrected by stopping the machine. It is known that any stopping or start-up operation always influences the roving tension, or the winding tension, respectively, as it depends to a great extent on the centrifugal force and on the air drag. If now the operating personnel e.g. detects too slack a roving tension in a given phase of the winding process, they can effect a corresponding correction at the correction element 60 while the machine is running and immediately can check the success of the corrective action. If, on the other hand, as with conventional machines, the machine is to be stopped first, and the correction is to be effected while the machine is at a standstill, and the machine thereupon is to be restarted again, the danger persists, that the influence of the stopping of the machine and of its restarting exceeds the correction to be effected, in which manner the correction operation is rendered difficult, if not impossible, as it is to be effected step by step in a long series of operations.

Figure 3:
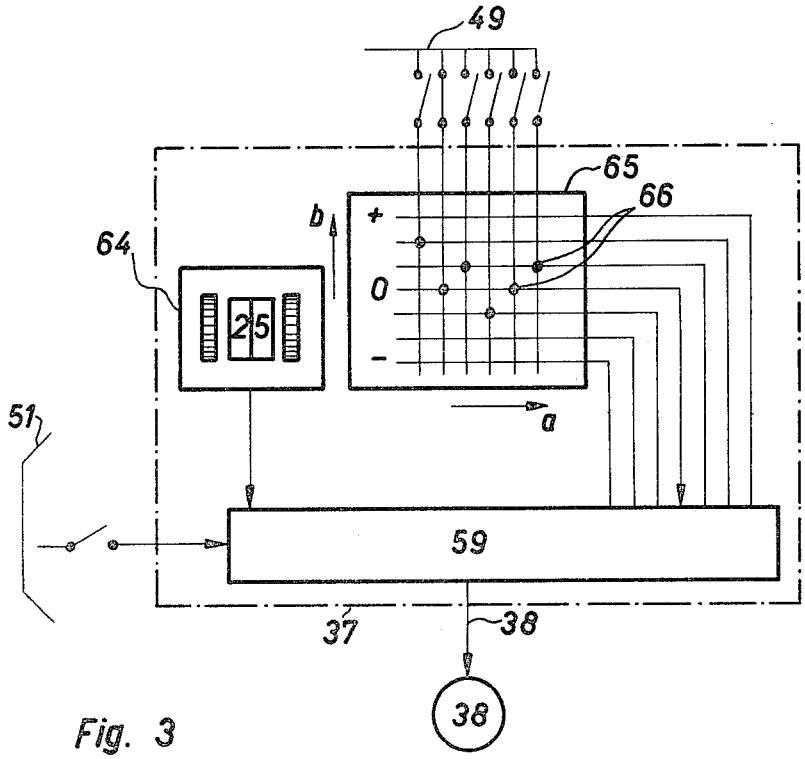
FIG. 3 is a block diagram of an inventive alternative design example of the apparatus for controlling a spinning preparatory machine according to FIG. 1.

A very interesting simplification of the inventive control arrangement can be achieved using a further preferred embodiment of the invention, which provides that the employed variator 28, over its whole control range shows a transmission ratio characteristic, which, using a linear control movement or adjustment, achieves a first approximation of the relation, known as such, between the spindle rotational speed and the bobbin diameter. The variator 28, in other words, can be designed such, that, if the control shaft 36 is further rotated always through the same amount, i.e. is moved or adjusted linearly, the ratio of the rotational speed of the main shaft 16 to that of the output shaft 29 in a first approximation equals the known, non-linear relation between the spindle rotational speed and the bobbin diameter. In this case it is sufficient, to set the set value transmitter or indicator 56 for the desired or set value to a number of switching pulses or impulses, which remains constant over the whole bobbin build, which represents a very considerable simplification, concerning the indicator 56 for the desired value, which in this case can be in the form of a decade switch 64, as shown in FIG. 3, as well as concerning the operation of the machine since only this constant value, but not its progress over the whole bobbin build, is to be set or adjusted.

Also advantageous is an inventive control apparatus, in which the control or adjustment motor 39 is chosen as a so-called stepping motor, i.e. a motor, which rotates stepwise over an angle or amount respectively, corresponding to the control pulses or impulses transmitted to it. If a motor of this type is employed, then the use of a feedback arrangement comprising a signal transmitter 62 and an electrical circuit 63 (FIG. 2) can be dispensed with, since the motor always is rotated through the correct angle. In FIG. 3, a particularly advantageous design example according to the invention is shown, in which the correction element consists of a crossbar distributor 65, one of the coordinates of which e.g. as shown in FIG. 3, the abscissa a, represents the bobbin diameter D, and the other, the ordinate b, represents the positive or negative correction of the number of impulses or pulses. As shown in FIG. 3, the contacting points of the contact transmitters 49, which are designed exactly like the ones shown in FIG. 1, are connected with the vertical bars of the crossbar distributor arrangement 65. Each vertical bar or rail thus corresponds to an exactly determined range of diameters, or to a layer, respectively, of the bobbin 6. In FIG. 3, e.g. six bars or rails are provided, i.e. the bobbin is subdivided into six cylindrical layers. The horizontal bars or rails of the crossbar distributor arrangement 65 are connected individually with the logic device or element 59. In this arrangement, the pulse scale b is subdivided into positive and negative values; points above the zero line correspond to increasing positive corrections (e.g. to positive pulse numbers, which, if summed up in the logic device or element 59 with the ones from the decade switch 64, effect an increase in the spindle rotational speed over the one corresponding to the set or adjusted desired or set value), whereas below the zero line the negative correction can be set. Setting of the correction in a crossbar distributor arrangement 65 is effected in known manner by establishing the contact between the vertical and the horizontal bars or rails, using e.g. contacting pins 66. In the example shown in FIG. 3, e.g. in the first layer of the bobbin 6 a positive correction of +2 impulses is set, in the second layer one of zero impulses, and in the third layer one of +1 impulse.

The use of a crossbar distributor arrangement 65 as a correction element, which of course also can be equipped with considerably more bars or rails, is very comfortable and easily recognizable for the operating personnel, and is suitable for the use of pin setting cards (cards on which the corrections used in a specific application are noted by punching the crossing points) for storing the correction adopted in a specific case for later re-use.

The electrical connections required for realisation of the inventive block diagrams described herein are known to any specialist skilled in the art and a more detailed description thereof thus can be dispensed with.

While there are shown and described present preferred embodiments of the invention, it is to be distinctly understood that the invention is not limited thereto, but may be otherwise variously embodied and practiced within the scope of the following claims. Accordingly,

We claim:

1. An apparatus for controlling the rotational speed of spindles of a spinning preparatory machine as a function of the increasing bobbin diameter of bobbins carried by the spindles and upon each of which bobbins there is formed a bobbin package, wherein flyers are operatively associated with the spindles carried by a spindle rail performing traversing movements, comprising:

an infinitely adjustable variator for the drive of the spindles;

a stepwise indexible control shaft for infinitely adjusting said variator;

an electric adjustment motor for driving said control shaft;

motor control means for inputting control pulses to said electric adjustment motor;

said motor control means comprising a programmable set value transmitter which can be externally set to a predetermined number of control switching pulses for each indexing step of said control shaft;

said motor control means further comprising an externally settable correction element for correcting the number of pulses determined by the set value transmitter by the addition or subtraction of correction pulses during each indexing step;

scanning means for scanning reversal points of a traversing stroke of the spindle rail carrying the spindles;

said scanning means delivering a command for outputting the control switching pulses of the motor control means;

means for determining the increasing bobbin diameter; and at least any one of said set value transmitter and said correction element being operatively connected with said means for determining the increasing bobbin diameter.

2. The apparatus as defined in claim 1, wherein:

said set value transmitter and said correction element are freely accessible to the operating personnel and can be set during operation of the spinning preparatory machine.

3. The apparatus as defined in claim 1, wherin:

said variator has a regulation range throughout which there prevails a transmission ratio which, with a linear setting thereof, realises a first approximation of the interrelationship between the spindle rotational speed and the bobbin diameter; and said set value transmitter is set throughout the entire bobbin package formation to a constant number of control switching pulses per indexing step.

4. The apparatus as defined in claim 1, wherein:

said adjustment motor comprises a stepping motor.

5. The apparatus as defined in claim 1, wherein:

said correction element comprises a crossbar distributor defining two coordinates, wherein one of the coordinates signifies the bobbin diameter and the other coordinate signifies a positive or negative pulse number correction.

6. The apparatus as defined in claim 1, further including:

means for kinematically rigidly coupling said means for determining the bobbin diameter with the control shaft of said variator.

* * * * *